US008136324B2

(12) United States Patent
Browning et al.

(10) Patent No.: US 8,136,324 B2
(45) Date of Patent: Mar. 20, 2012

(54) SNAP-FIT PULTRUSION FOR HOUSING ELEMENTS

(75) Inventors: Raymond Browning, Shoreham, NY (US); W. Brandt Goldsworthy, Palos Verdes Estates, CA (US); Lois Goldsworthy, legal representative, Palos Verdes Estates, CA (US)

(73) Assignees: James M. Dombroski, Petaluma, CA (US); Craig M. Stainbrook, Santa Rosa, CA (US); Larry D. Johnson, Celebration, FL (US)

( * ) Notice: Subject to any disclaimer, the term of this patent is extended or adjusted under 35 U.S.C. 154(b) by 0 days.

(21) Appl. No.: 11/547,882

(22) PCT Filed: Apr. 8, 2005

(86) PCT No.: PCT/US2005/011859

§ 371 (c)(1), (2), (4) Date: Oct. 4, 2006

(87) PCT Pub. No.: WO2005/099396

PCT Pub. Date: Oct. 27, 2005

(65) Prior Publication Data

US 2008/0047217 A1 Feb. 28, 2008

(51) Int. Cl.
*E04B 2/00* (2006.01)

(52) U.S. Cl. ..... 52/588.1; 52/582.1; 52/580

(58) Field of Classification Search ..... 52/582.1, 52/588.1, 793.1, 580, 589.1
See application file for complete search history.

(56) References Cited

U.S. PATENT DOCUMENTS

| | | | | |
|---|---|---|---|---|
| 3,372,520 | A * | 3/1968 | Hensel | 52/489.1 |
| 3,815,311 | A * | 6/1974 | Nisula et al. | 52/579 |
| 4,236,366 | A * | 12/1980 | Rijnders | 52/580 |
| 5,201,159 | A * | 4/1993 | Goranson et al. | 52/580 |
| 5,595,038 | A * | 1/1997 | Prestenback | 52/592.1 |
| 6,658,808 | B1 * | 12/2003 | Doherty et al. | 52/580 |
| 7,243,464 | B1 * | 7/2007 | Crowell | 52/93.2 |

* cited by examiner

*Primary Examiner* — Basil Katcheves
(74) *Attorney, Agent, or Firm* — Craig M. Stainbrook; Stainbrook & Stainbrook, LLP

(57) ABSTRACT

The invention provides snap fit pultrusion housing elements for joining structurally insulated panels suitable for housing and shelter construction. The housing elements include a pultruded panel body member having at least one edge, and a pultruded snap lock fitting on the edge adapted for fastener-less engagement with a complementary fitting on an adjacent panel body member.

1 Claim, 12 Drawing Sheets

SNAP-FIT PULTRUSION FOR HOUSING ELEMENTS

BACKGROUND OF THE INVENTION

1. Technical Field

The present invention relates generally to structural materials, and more particularly to prefabricated structural members, and still more particularly to snap fit pultrusion housing elements for joining structurally insulated panels suitable for housing and shelter construction.

2. Background Art

The construction of shelters for housing is older than civilization itself, and the development of materials and structures to aid in such construction is equally old. In the industrialized world, construction materials and techniques have reached a very high level of maturity. However, housing is increasingly expensive and there is a continuing need for improved materials that are less expensive to manufacture and utilize in constructing structures, that are structurally stronger and less vulnerable to degradation from exposure and use, and that provide suitable physical and aesthetic conditions for occupancy. Additionally, there is a need for lightweight and easily transportable structural elements for rapid erection of remote emergency shelters, for low cost housing elements suitable for use by the peoples of industrializing countries, and for rapid deployment of shelters for military personnel.

Despite these longstanding needs, housing technology has evolved relatively slowly in recent years. Construction principles, materials, and methods largely remain wedded to the "stick and mud" principles practiced for hundreds of years. A few systems have been developed to streamline or otherwise improve on conventional construction practices, including those disclosed in the following exemplary patents:

U.S. Pat. No. 6,007,656 to Heikkila et al., shows a method of manufacturing a composite material structural member having a significantly improved Young's modulus providing strength for applications such as telephone poles, electric poles, electric lighting poles, boat mast or keel applications, lumber replacements, structural members used in window and door manufacture, etc.

U.S. Pat. No. 4,764,451 to Butcher, discloses a modular unit construction having first and second modular building units for positioning on a parcel. Each modular unit has a generally planar wall portion, the units being positionable with the planar wall portions in generally parallel spaced relation, and in the case of home construction, first and second garage units configured for attachment, or a look of attachment, in contiguous relation interconnecting the spaced wall portions. The system includes a roof of generally identical composition on each of the garage units, and on corresponding portions of each of the modular building units. The roofs of the building units are in an abutting relationship and share continuous lines to present the appearance of one continuous roof, thereby giving the appearance of an integrated single building, or in the case of home construction, of a single residence or duplex.

U.S. Pat. No. 6,272,802 to Berberich, teaches a modular building system employing interlocking building elements. The system employs numerous building elements, including a fastening piece that has a scarf joint formed within a forward edge of the piece running the entire length of the first surface. First and second assembly pieces constitute additional building elements of the system. Each of the pieces includes a first scarf joint formed proximate a rearward edge of the piece which runs the length of the outer surface. A second scarf joint is formed proximate the forward edge of the piece and runs the length of the inner surface. Additionally, a transverse scarf joint is formed perpendicular to the second scarf joint and runs the entire width of the first end. This transverse scarf joint is interconnected to the first end of the fastening piece. In a similar fashion, the transverse scarf joint of the second assembly piece is interconnected to the second end of the fastening piece. Other building elements include a series of panels, each of which is defined by a rounded forward surface and a planar rearward surface. The panels include upstanding upper and side edges, and a lower scarf joint. The panels are adapted to be slid in between the first and second assembly pieces, with the upstanding side edges being received within the second scarf joints of the assembly pieces and with the upstanding upper edge of each panel being positioned within the scarf joint of the adjacent panel. In this manner a fluid tight seal is created between adjacent panels. Finally, a second fastening piece is secured to the second ends of the first and second assembly pieces with the series of panels secured therebetween. The first and second assembly pieces, the first and second fastening pieces, and the series of panels thus form a complete modular unit. An elongated joining piece can be secured within the facing first scarf joints of adjacent assembly pieces to permit the coupling of adjacent modular units.

As will be appreciated by those with skill in the art, it is known to provide prefabricated modular units for the construction of building structures. Further, it is known to provide pultrusion products for use as structural elements in building construction. Pultruded products have numerous advantages over conventional building materials. Relative to structural steel and aluminum, and to conventional building lumber, pultruded fiber reinforced thermoplastics are stronger, lighter, more corrosion and rot resistant, are less electrically conductive, and have greater dimensional stability.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The snap fit pultrusion for housing elements of the present invention provides snap-lock housing technology for a flexible system of shelter construction using composite materials. These shelters can be assembled on site from sections of snap-lock panels—flooring, wall and roofing—to form a complete housing, office, or storage unit. Shelters formed using the inventive technology are strong, fast to assemble and are very protective from environmental extremes. The construction is frameless and needs only a footing or simple grading. The shelter system can be made completely livable with built-in utilities and pre-decorated surfaces.

The invention further provides a refined method of housing construction that incorporates the advantages of composite materials with the pultrusion process for manufacturing the panels and the innovative snap-lock (fastenerless) joint system. Composite materials provide structural superiority, better thermal dynamics, no rotting and protection from pest problems. Snap-lock joints allow for easy assembly and structural integrity not found in conventional building methods and materials. Once construction is complete, structures are suitable for emergency dwellings, factory tilt-ups and high quality custom housing.

This technology is suitable for a housing package consisting of automated fabrication of structural insulated panels by pultrusion and the novel snap-lock joining technology. It is estimated that a three-bedroom, two-bathroom, 1200-sq.ft. house can be assembled in four hours with unskilled labor, with on-site assembly possible in virtually all weather conditions, allowing year-round and emergency home construction.

The pultrusion process is an efficient means of pulling fiber reinforcements through a bath of polyester resin to create lineals, in this case housing panels. The pre-measured, indexed and identified parts are made of commodity materials and are ready for assembly on site. Compared with most commercial composite manufacture methods, the pultrusion process gives increased productivity for large scale demands with very controllable economic advantages and great structural strength with engineering flexibility.

The inventive housing technology can be packaged in a shipping container, making it suitable for delivery by flat bed truck or air-drop to remote sites. The housing technology needs only minor training to assemble and immediately forms strong structural elements that are safe and protective to work within. The housing technology can include a variety of materials—insulating, lightweight, impact proof—that are enrobed in the composite pultrusion fittings that make up the core of the innovative technology.

Housing parts are limited only by the size of the pultrusion machine and can be used to make multiple layers with cores made of urethanes, phenolythics, balsa, or Keviar. Truck and train refrigeration cars using this design have been in use a number of years and the results have been exceptional. There are favorable comparisons in cost, corrosion elimination, thermal integrity, major weight reduction, durability and design flexibility.

The inventive housing technology has two functional parts, the snap lock fitting and the panel body or housing section. Both these parts are formed together in the pultrusion process. There are a variety of different fittings and panels for different uses. To form a larger panel for a floor or wall, a filler such as a flat 10'×20'×4" section of polyurethane foam, balsa, or material is pultruded through a machine which lays down a glass fiber skin, top and bottom, on the filler while at the same time pultrusing the snap-lock fitting on the edges of the panel—the fitting would attach a wall to a floor section, for example, the wall panel having a tongue that slips into a groove in the floor fitting. The wall then rotates around the pivot point and snaps into place in an upright position. The radius of the fitting is such that the inner decorated surfaces of the wall and floor do not mar as they mate and also form a watertight seal with the addition of a small mastic bead along the guide surfaces. The two outer skins are formed of a glass phenol matrix and a foam center made of polyurethane. The snap fit locks in place and is a very strong joint giving a free standing wall. The same joint can be modified to work in the opposite direction of locking for two floor to floor panels or roof to roof panels.

Variations on the snap-lock design give a full range of fittings to enable the construction of a complete shelter. The hollow sections of the snap fit extrusions can be used as conduits for electricity, gas, and water utilities thoughout the complete snap fit composite housing structure. Each housing section can be provided at the time of manufacture with an integrated utility supply appropriate to its housing function. For example power outlets can be integrated into the interior sides of the walls and the snap fit extrusions used as conduits for cables with plugs to mate with other sections. The range of potential applications includes emergency housing and storage spaces in extreme climates. The weight and costs for these applications is very competitive. Estimated costs for a 1,200 square foot house with a pitched roof and loft, interior walls for three bedrooms, two baths, a living/dining room and a kitchen would have a shell weight (no fittings) of 4,000-5,000 pounds and a cost between $10,000-15,000.

It is therefore an object of the present invention to provide a new and improved structural building panel.

It is another object of the present invention to provide a new and improved snap lock fitting for housing elements.

A further object or feature of the present invention is a new and improved interlocking panel arrangement for building construction.

An even further object of the present invention is to provide a novel method and apparatus for constructing housing and shelters.

Other novel features which are characteristic of the invention, as to organization and method of operation, together with further objects and advantages thereof wilt be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and the objects and advantages of the present invention will become apparent when consideration is given to the following detailed description thereof. Such description makes reference to the annexed drawings wherein.

BEST MODE FOR CARRYING OUT THE INVENTION

Figure 1:
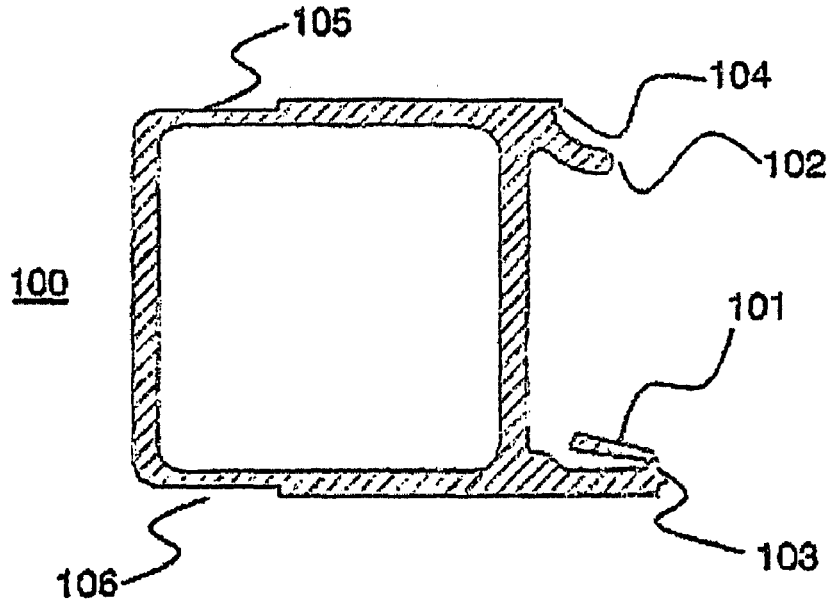
FIG. 1 is schematic cross-sectional side view in elevation of a tongued pultrusion joint unit of the present invention.

Referring to FIGS. 1 through 18B, wherein like reference numerals refer to like components in the various views, there is illustrated therein a new and improved modular system for constructing housing which employs fiberglass skin and foam core structurally insulated panels (SIPs), in connection with a number of novel snap-lock joints for joining walls to walls, walls to floors, walls to ceilings and roofs, and so forth. The inventive SIPs can be fabricated using a continuous process of joining thermosetting resin with fiberglass reinforcement (i.e., fiber reinforced plastic, or pultrusion) to provide a nearly complete structural wall, floor, ceiling, or roof panel. The panels are insulative, non-corrosive, environmentally benign, and exceptionally sturdy and durable. The panels can be shipped directly from manufacture to the construction site.

Advantages of the present invention over wood, concrete, and steel structures include the following:

(a) low thermal conductivity (excellent insulator qualities);
(b) chemical resistance;
(c) electrically non-conductive;
(d) maintains properties under wide range of temperatures;
(e) capable of attaining Class 1 fire and smoke ratings; and
(f) excellent weather resistance.

Figure 2:
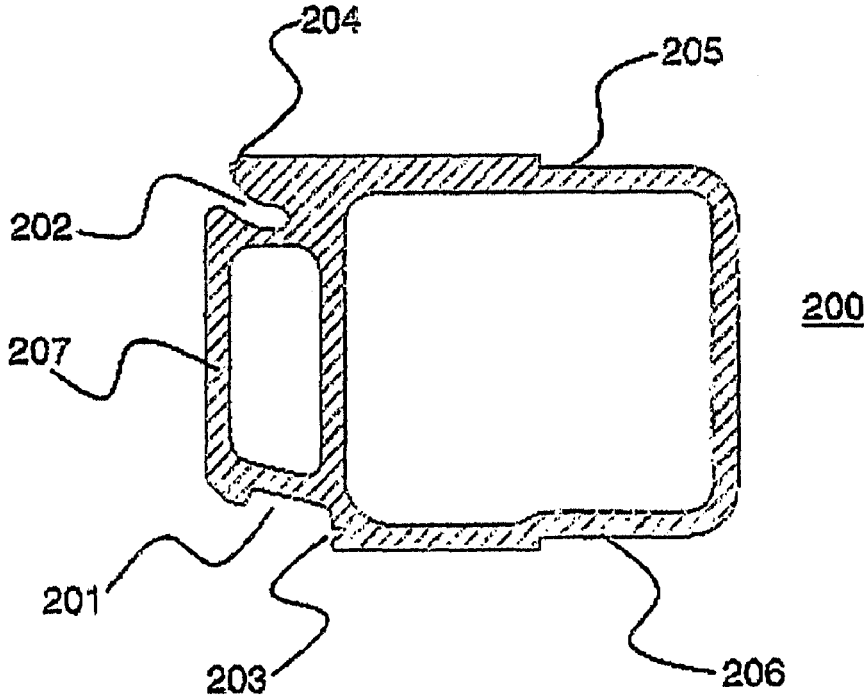
FIG. 2 is a schematic cross-sectional side view in elevation of a grooved pultrusion joint unit of the present invention, adapted for mating with the tongued unit of FIG. 1.

A first preferred embodiment of a snap fit or snap-lock joint of the present invention is shown in FIGS. 1 and 2. [Note: the terms "snap fit" and "snap-lock" are used interchangeably herein.] FIG. 1 is a schematic cross-sectional side view in elevation of a tongued pultrusion joint unit 100 which has a clip 101, a tongue 102, a raised bead 103, a sealing bead 104, and two recessed sections 105 and 106.

FIG. 2 shows a grooved pultrusion 200 which has a clip receptacle 201, a circular groove 202, a bead mating groove 203, a sealing groove 204, two recessed sections 205 and 206 and a support member 207.

Figure 3:
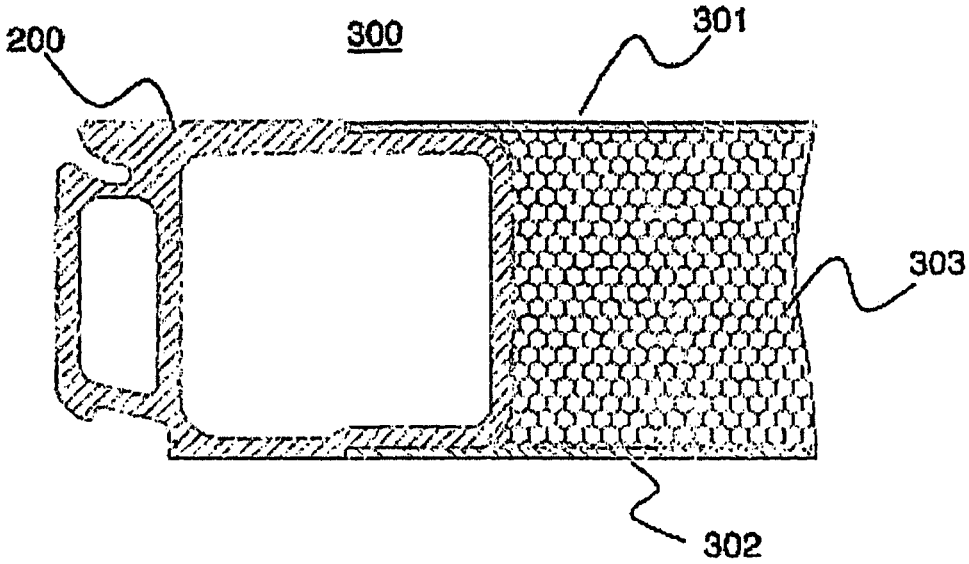
FIG. 3 is a schematic cross-sectional side view in elevation showing detail of part of a housing element such as a floor, wall, or roofing element.

FIG. 3 shows a detail of part of a housing element 300 such as floor, wall, or roofing element. The housing element 300 is formed when the grooved pultrusion 200 (FIG. 2) is bonded to two material layers 301 and 302 which form the surfaces of the housing element and which sandwich a stiffening element 303 such as a foam insulation layer. The two material layers 301 and 302 fit flush in the recessed sections 205 and 206 of the grooved pultrusion. A similar housing element can be formed using the tongued pultrusion 100 (FIG. 1), two material layers 301 and 302, and a stiffening layer 303.

Figure 4:
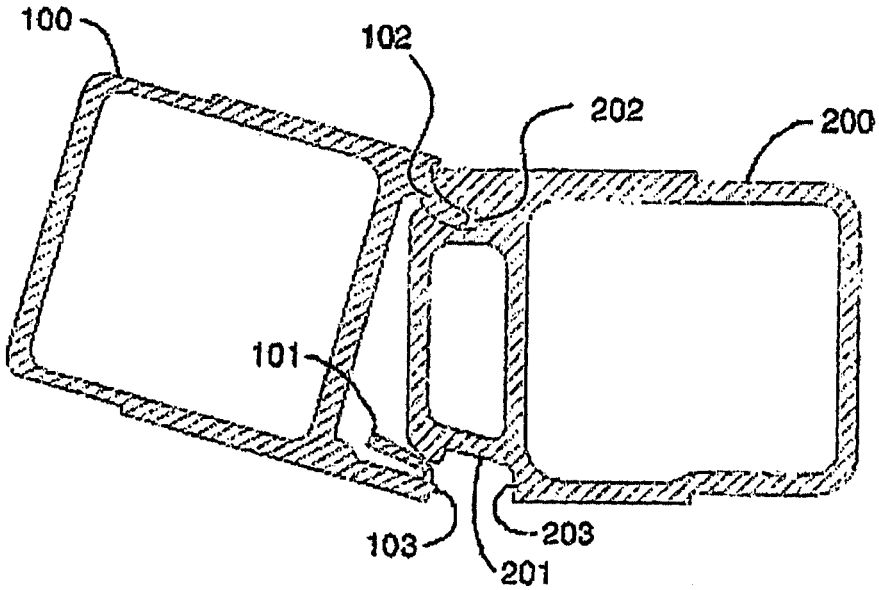
FIG. 4 is a schematic cross-sectional view in elevation showing the units of FIGS. 1 and 2 in the process of being mated together.

FIG. 4 shows how the tongued pultrusion 100 and the grooved pultrusion 200 initially mate together. The tongue 102 of the tongued pultrusion 100 is slotted into the circular groove 202 of the grooved pultrusion 200. The housing element that would be formed including the tongued pultrusion 100 is used as a lever to press home the clip 101 into the clip receptacle 201. The tongue 102 and circular groove 202 move the trajectory of the mating pultrusions 100 and 200 together to form a very positive fit. On one side of the mated housing elements the raised bead 103 on the tongued pultrusion 100 slots into the bead mating groove 203 on the grooved pultrusion 200 to give an accurate positional mating on both sides of the pultrusions.

Figure 5:
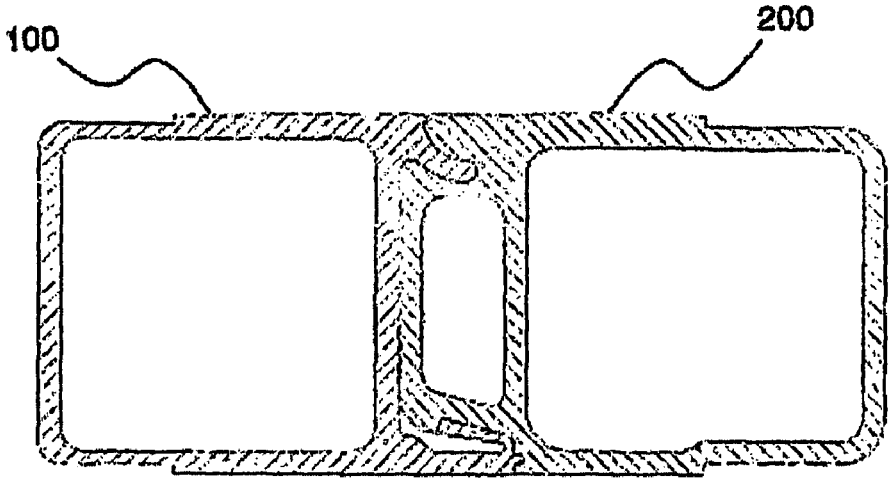
FIG. 5 is a schematic cross-sectional side view in elevation showing the tongued pultrusion of FIG. 1, and the grooved pultrusion of FIG. 4 in their snap fit configuration.

FIG. 5 shows the tongued pultrusion 100 and the grooved pultrusion 200 in their snap fit configuration.

Slotting two housing elements together at an angle and rotating one pultrusion to a snap fit can be accomplished even when the other pultrusion has been pre-affixed to studding or joists.

A bead of non-setting mastic, an elastomer part, or simply a caulked line along the bead mating groove 203 (or raised bead 103) can be added and as the pultrusions mate this bead is squeezed and forms a sealed joint. The sealing bead 104 and sealing groove 204 on the tongue and groove side of the pultrusions can also be caulked to give a sealed joint on the other surface. The leverage exerted by the housing element attached to the tongued pultrusion is large and thus very effective in squeezing a caulked or mastic bead with little effort by the assembler. The parts simply slip together and are pushed down into place.

The center of revolution for the tongue fitting is at the surface of the grooved pultrusion. The surfaces can thus rotate into each other and form a flush surface without contact between the edges as they come together. The center of revolution at the surface also means that the edges of the parts do not scrape or mar each other and a close esthetically pleasing joint is formed with little chance of chipping. A surface coat of paint can therefore be pre-applied.

If another surface finish such as a textured and tinted finishing board is pre-applied to the surface of the pultruded parts, then the center of revolution should be at the surface of the applied board so that a good mate between the edges of the finished boards is had without marring the edges. In fact the criteria for not marring the joining surfaces is that the center of revolution should be at the surface or just above the surface, while the criteria for a tight joint between the edges is that the center of revolution is at or just below the surface.

Any arbitrary obtuse angle (90-180 degrees) can be accommodated by the correctly designed pultruded parts based on the designs of FIGS. 1 and 2. Thus a similar pair of pultruded parts are used for corners where the pultrusions mate together to form a right angle joint, instead of a flush joint.

Figure 6:
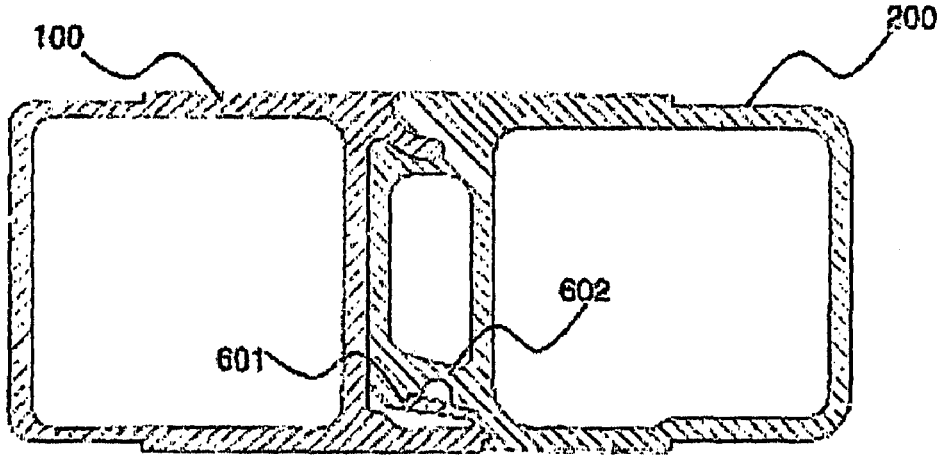
FIG. 6 is a schematic cross-sectional side view in elevation showing a snap fit joint that facilitates disassembly.

The snap fit joints can also be disassembled. The joints can be disassembled by sliding a rod between the clip 101 and the clip receptacle 201. A snap fit joint that further facilitates disassembly is shown in FIG. 6. The clip receptacle 601 can be shaped to give a keyed slot 602 to guide the rod.

The basic design of the snap fit joint described above can be adapted to the multiple geometric elements that form a housing structure. The most critical issue for any jointing system is to have elements join together to form larger elements. For example, it is desirable to have multiple flooring sections join together to make a floor. It is also desirable to have a floor to wall joint, a wall to wall corner joint, a wall to roof joint, etc. It is the case with many jointing systems that different joint designs are used for the jointing of these different elements. It is a feature of this inventive snap fit jointing system that the basic design can be adapted to joint the majority of joints in a structure.

Figure 7:
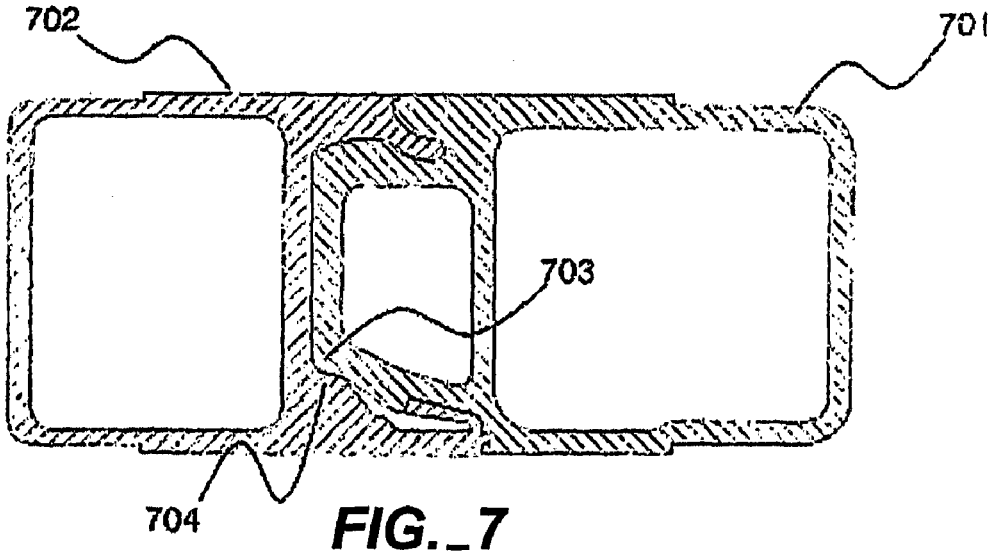
FIG. 7 is a schematic cross-sectional side view in elevation showing how the fit of a joint employing the units of the present invention can be modified to equalize the load bearing capacity of each side.

For load carrying purposes it is desirable that the snap fit joint carry the load when either the tongued side of the joint is supported or the grooved side of the joint is supported. In FIG. 5 the joint can carry the largest load when the housing element with the grooved pultrusion 200 is supported by a foundation or joist. The fit of the joint can be changed to more equalize the strength of each side as shown in FIG. 7. The extended grooved pultrusion 701 joints to a recessed tongued pultrusion 702 so that an elbow 703 of the extended grooved pultrusion 701 rests on a shoulder 704 of the recessed tongued pultrusion 702.

Figure 8:
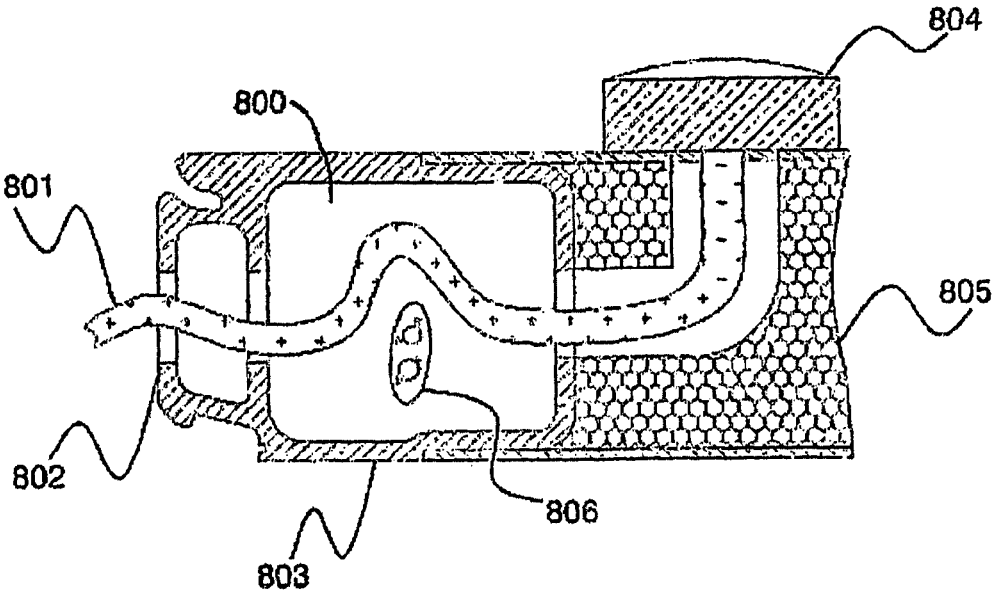
FIG. 8 is a schematic cross-sectional side view in elevation showing how electrical cable may be passed through openings in a pultrusion snap part of the present invention.

As illustrated in FIG. 8, the hollow section 800 of the pultrusion can be used as a conduit for power cables and other utilities. The pultrusion can be cut though at intervals without breaking the sealing surfaces so that fittings can be connected through to the utilities. FIG. 8 shows an electrical cable 801 passing through an aperture 802 into a pultrusion snap part 803 to connect with an electrical outlet 804 on the surface of a housing element 805. The hollow section of the pultrusion snap part 803 can also be used as a conduit for a second electrical cable 806 shown in section.

Figure 9:
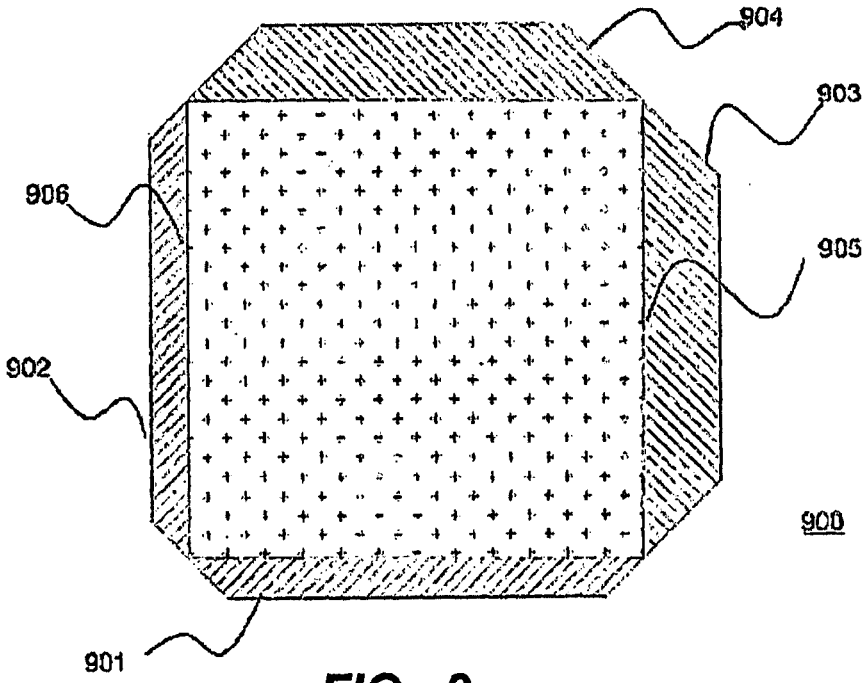
FIG. 9 is a schematic top plan view of a square flooring element which includes a combination of the tongued and grooved pultrusion joint elements as shown in FIGS. 1-8.

Sections of snap fit housing elements can be combined together to form larger housing elements such as floors. A square section of flooring would have two tongued pultrusions and two grooved pultrusions on the four sides. FIG. 9 shows the arrangement of these pultrusions. The square section of flooring 900 has two tongued pultrusions 901 and 902 and two grooved pultrusions 903 and 904. The tongued pultrusions 901 and 902 and the grooved pultrusions 903 and 904 are mitered at the corners to allow the snap fit to operate freely in two dimensions. The sealing groove 905 and the sealing bead 906 on the top surface are continuous to the corners of the square section of the flooring 900.

Figure 10:
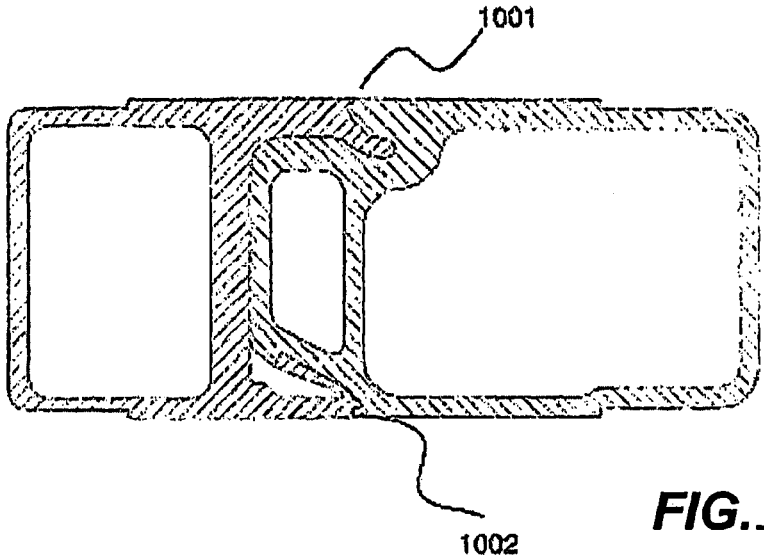
FIG. 10 is a schematic cross-sectional side view in elevation showing an arrangement of sealing beads and sealing grooves in the same plane for both the top and bottom surfaces.

To seal the bottom surface of the flooring element, the clip arrangement should be slightly altered relative to the arrangement shown in FIG. 5. To seal on all four sides on both the top and bottom surfaces the sealing beads and sealing grooves should be in the same plane for both the surfaces. FIG. 10 shows this arrangement. The seal at the top surface 1001 and the seal at the bottom surface 1002 are vertical relative to one another. With the seals in the same plane the seals at the top and bottom surfaces form a continuous system of seals around the square section of flooring 900. To form a complete floor the sections of flooring are first joined across the floor in one direction to form multiple strips. These strips are then joined together in the other direction.

Figure 11:
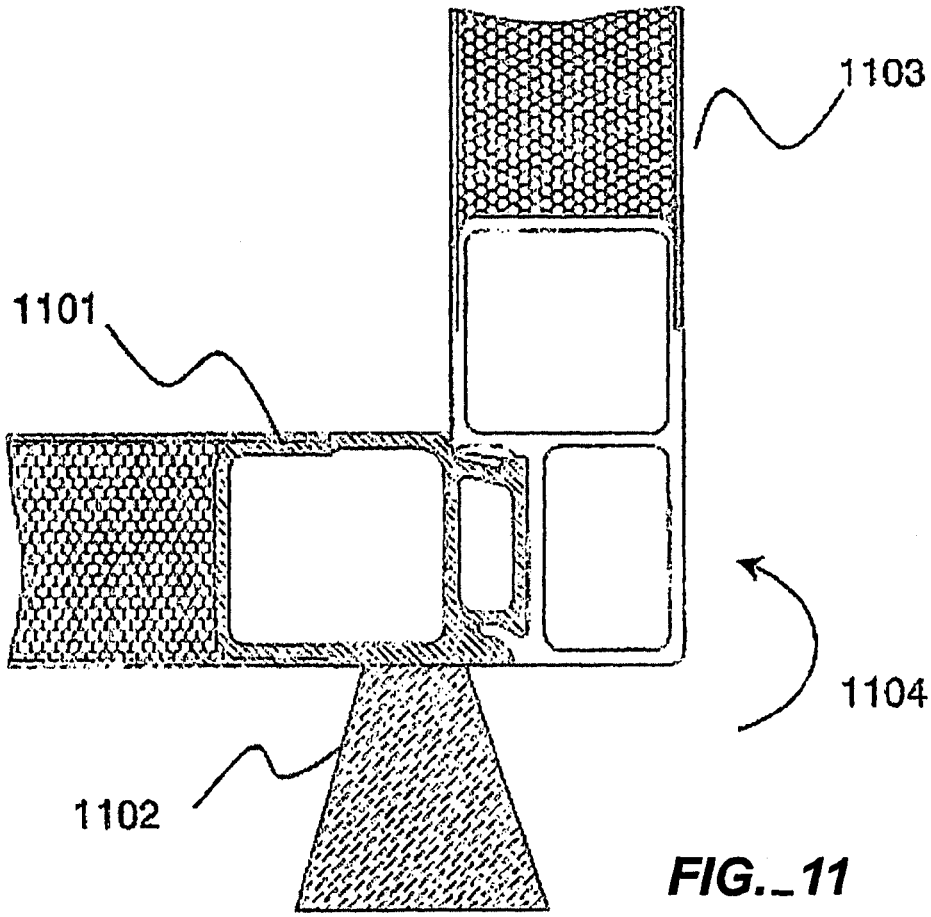
FIG. 11 is a schematic cross-sectional side view in elevation showing a floor/wall joint employed to connect a wall to a floor resting on a footing.

The inventive snap fit joint can be adapted to many situations. FIG. 11 shows the joint used to connect a floor 1101 resting on a footing 1102 with a wall 1103 that has been rotated into position in the direction of the arrow 1104.

Wall corners, roofing, and other features can be designed with the snap fit joint so that a complete disassembled house can be transported very economically in the volume of a shipping container.

Figure 12A:
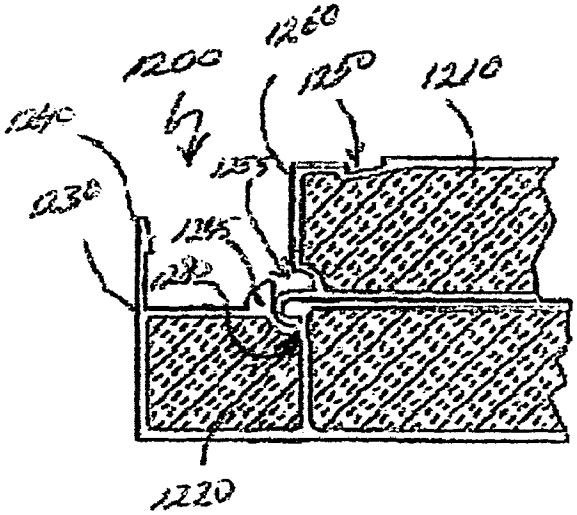
FIGS. 12A-C comprise a series of schematic cross-sectional side views in elevation of an alternative embodiment of a snap-lock joint for mating wall and floor panels.
Figure 12B:
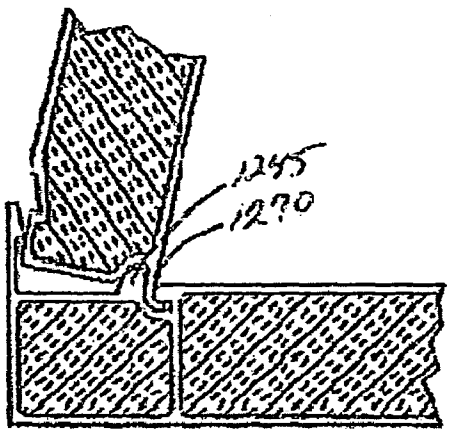
Figure 12C:
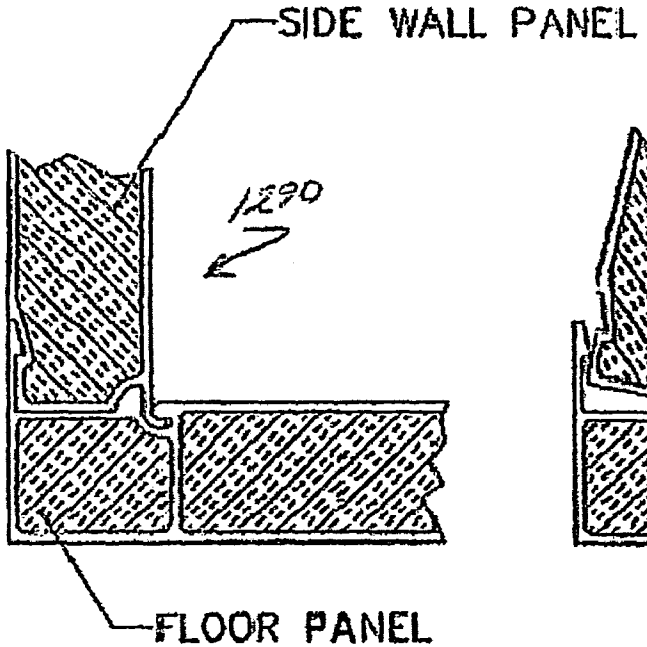

FIGS. 12A-C are a series of schematic cross-sectional side views in elevation showing the snap-lock joining of a side wall panel 1210 to a floor panel 1220 via an alternative embodiment of a snap-lock joint 1200. The floor panel joint member 1230 includes a male clip 1240 adapted for matable clipping into a first female recess 1250 in the side wall panel joint element 1260, and it further includes a shoulder 1245 adapted for matable insertion into a second female recess 1255. In turn, the side wall panel joint element includes an arcuate male tongue 1270 which is indexed relative to an arcuate channel 1280, after which the side wall panel is rotated upwardly into its substantially vertical position 1290, at which point clip 1240 snaps into a locked position with first recess 1250, and shoulder 1245 fully inserts into second recess 1255.

Figure 13:
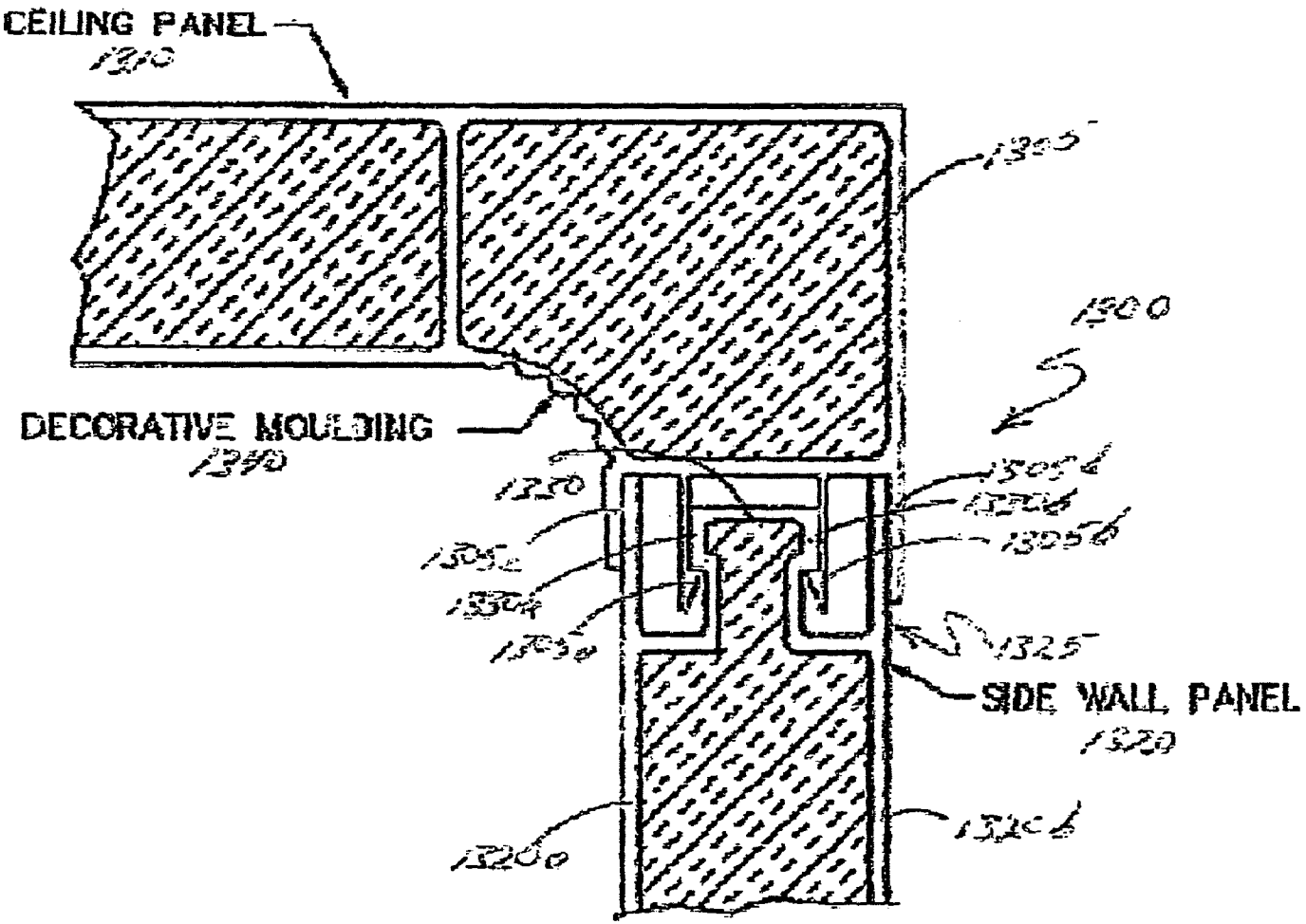
FIG. 13 is a schematic cross-sectional side view in elevation showing a preferred embodiment of side wall and ceiling panel snap-lock joint.

FIG. 13 is a schematic cross-sectional side view in elevation showing a preferred embodiment of side wall and ceiling panel snap-lock joint 1300, comprising a ceiling panel 1310 having a joint element 1305, which includes two downwardly depending male clips 1305*a*, 1305*b*, an interior surface extension 1305*c* and an exterior surface extension 1305*d*; and a side wall panel 1320 having an interior surface 1320*a* and an exterior surface 1320*b*, and a joint element 1325 disposed at its upper edge which includes a male T-post 1330 having outwardly extending shoulders 1330*a*, 1330*b*. The joining of the ceiling and wall panels is effected when the ceiling panel joint element 1305 is pressed down into and over the side wall panel joint element 1325, the male clips 1305*a*, 1305*b* slide over and clip into the shoulders 1330*a*, 1330*b* of the T-post 1330, and the ceiling panel joint element interior and exterior extensions 1305*c*, 1305*d*, approximate and slide over the interior and exterior sides 1320*a*, 1320*b* of the side wall panel. This view also shows how a decorative molding 1340 can be integrated into the joint element of the ceiling panel.

Figure 14:
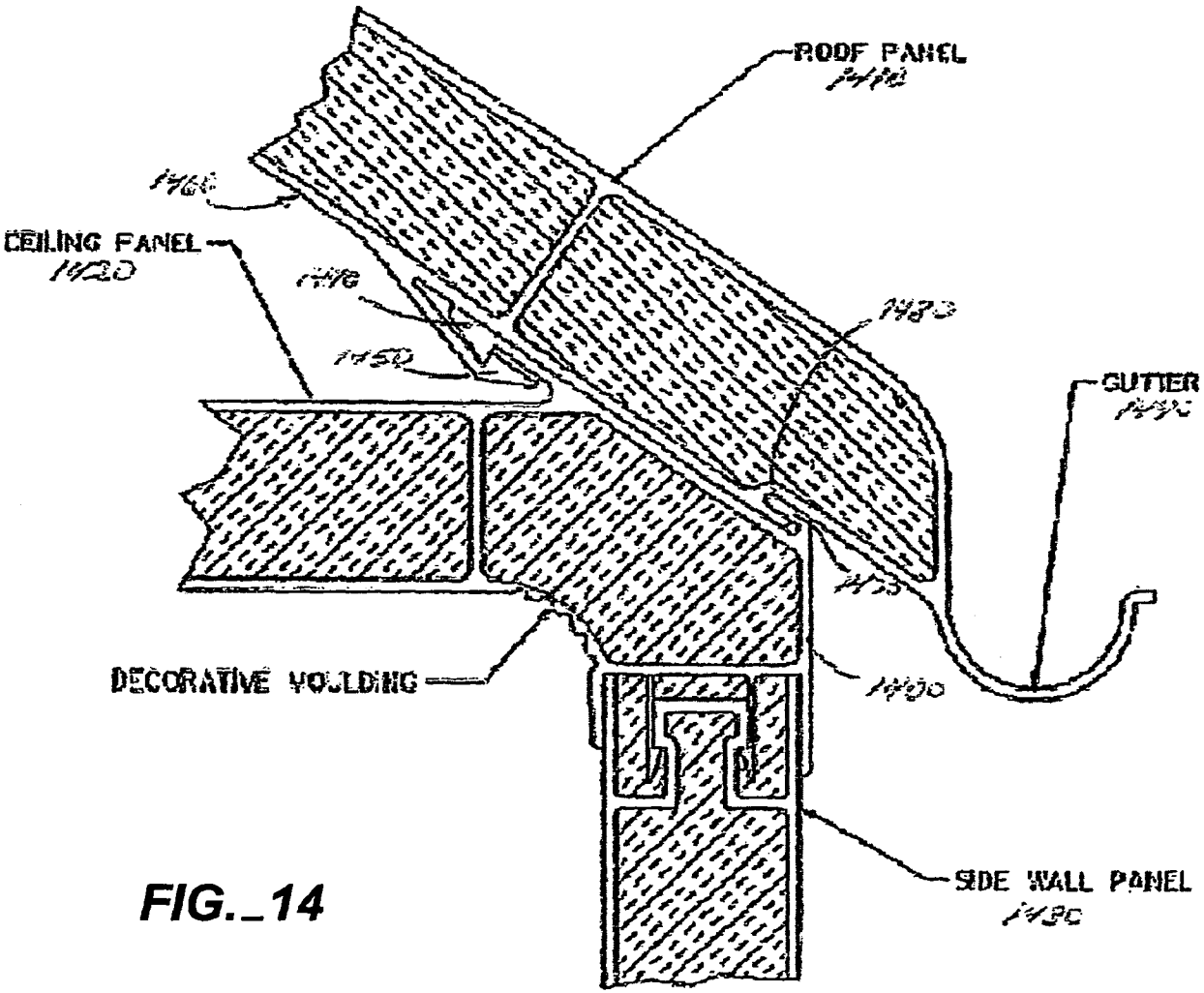
FIG. 14 is a schematic cross-sectional side view in elevation showing an alternative configuration for the corner of a side wall and ceiling panel joint, which includes a snap-lock fitting for attaching a roof panel.

FIG. 14 is a schematic cross-sectional side view in elevation showing an alternative configuration for a ceiling panel joint element 1400, which includes a snap-lock structure for matable attachment to snap-lock sloped roof panel 1410, thereby creating a complete junction of a ceiling panel 1420, side wall panel 1430, and roof panel 1410. The joint structure includes a rearwardly sloped clip 1440 adapted for matable interlocking connection with an opposing clip 1450 disposed on the underside 1460 of the roof panel; and a similarly angled bracket 1470 adapted for insertion into a channel 1480 disposed on the underside 1460 of roof panel 1410. The roof panel may include a gutter 1490, incorporated into the panel at the time of manufacture.

Figure 15A:
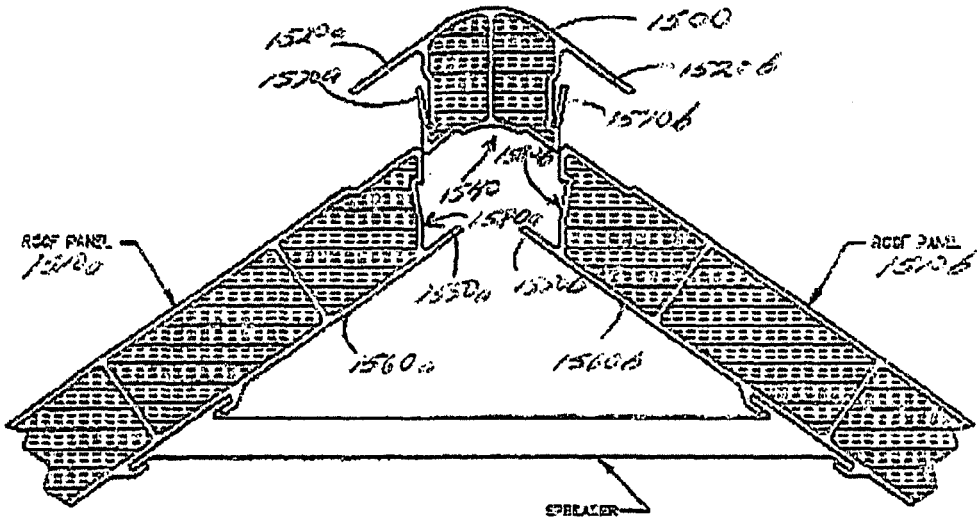
FIGS. 15A and 15B show the junction and joining of sloped roof panels in a snap-lock ridge beam member.
Figure 15B:
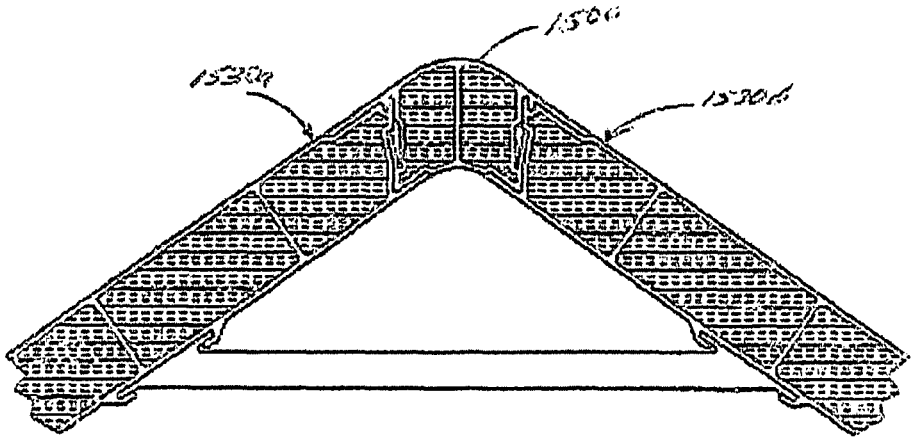

FIGS. 15A and 15B show the use of a snap-lock ridge beam member 1500 to form the junction of two opposingly sloped roof panels 1510*a*, 1510*b*. The ridge beam member 1500 includes two downwardly sloped wings 1520*a*, 1520*b* which are flush with the exterior surface 1530*a*, 1530*b* of the respective roof panels after installation. The ridge beam 1500 further includes a concave lower side 1540 which conforms to extensions 1550*a*, 1550*b* of the undersides 1560*a*, 1560*b*, of roof panels 1510*a*, 1510*b*. Finally, the ridge beam 1500 includes upwardly disposed clip members 1570*a*, 1570*b*, which are compressed as the beam is inserted between the opposing roof panels, and which clip into mating engagement with recesses 1580*a*, 1580*b*, of the roof panels. Spreader 1590 may interconnect roof panels 1510*a*, 1510*b* by engagement into channels 1592*a*, 1592*b*.

Figure 16A:
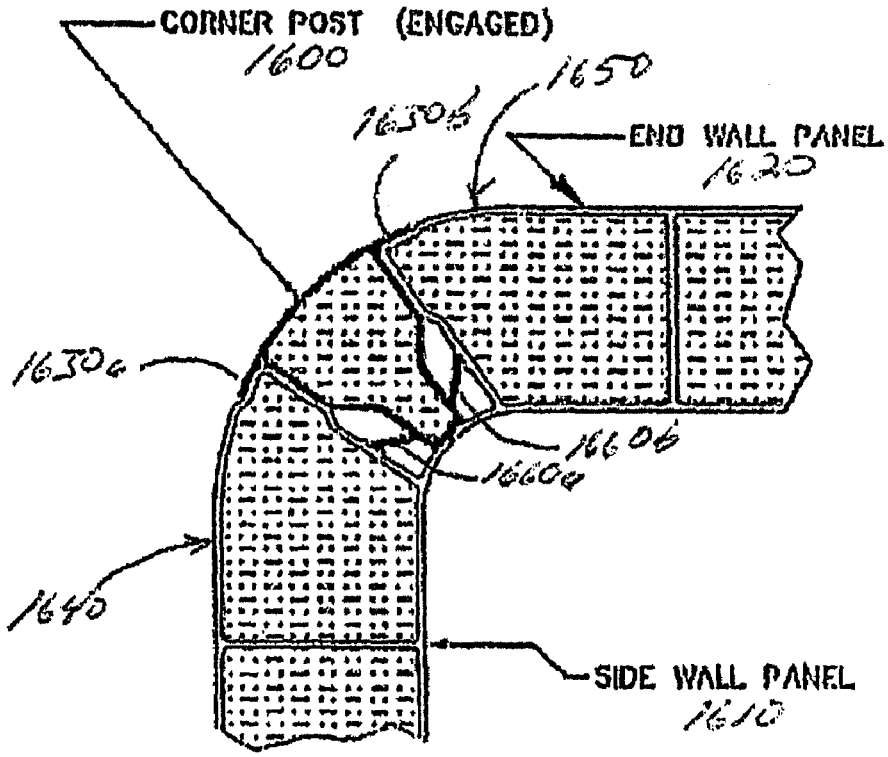
FIGS. 16A and 16B show the junction and joining of a side wall panel and an end wall panel with a snap-lock corner post.
Figure 16B:
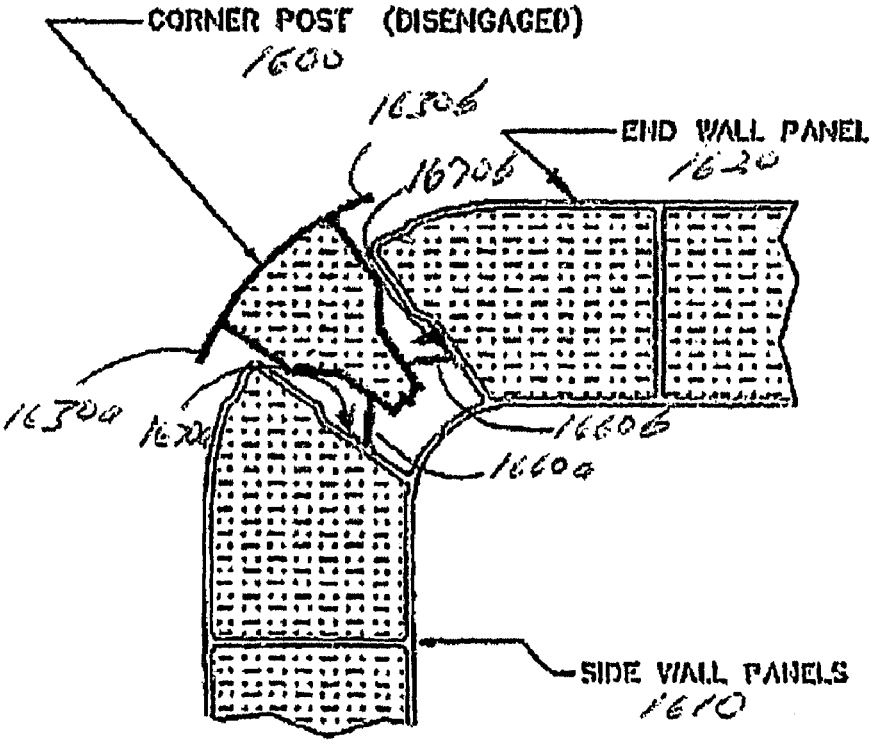

FIGS. 16A and 16B show a snap-lock corner post 1600 employed to form the junction and joining of a side wall panel 1610 and an end wall panel 1620. As with the ridge beam (FIGS. 15A-15B), the corner post includes two wings 1630*a*, 1630*b*, which are flush with the exterior surfaces 1640, 1650, of the side and end wall panels after installation. Two clip members 1660*a*, 1660*b*, are employed to engage and lock into recesses 1670*a*, 1670*b* of the side and end wall panels, respectively, each having ridges or longitudinal teeth to capture and retain the clip members.

Figure 17A:
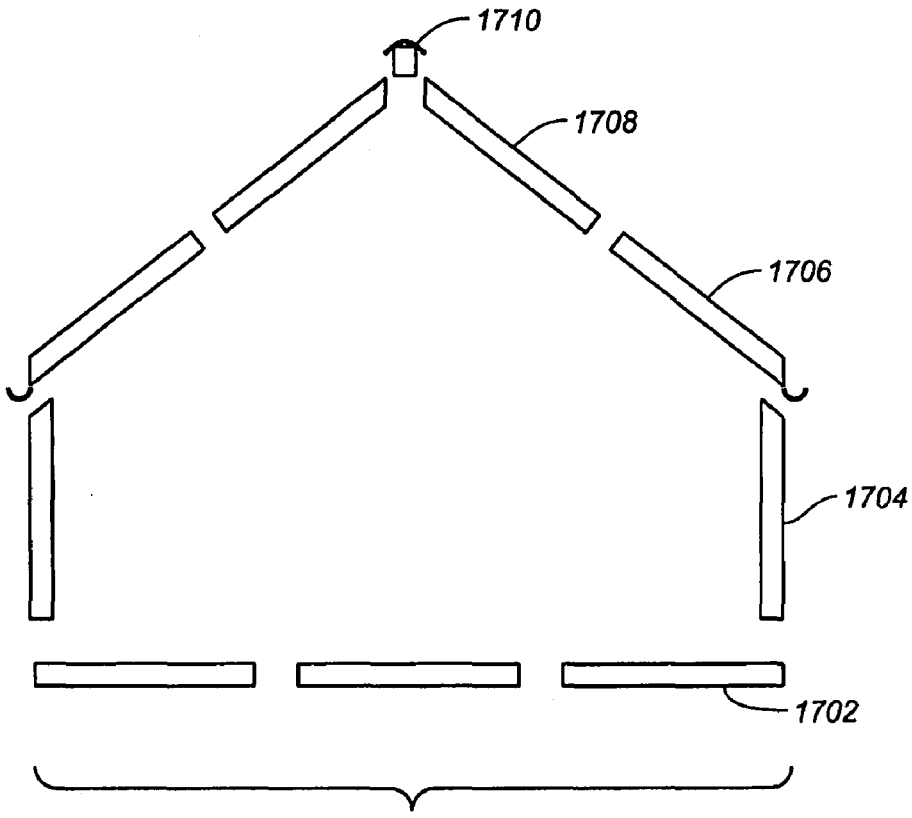
FIGS. 17A and 17B are schematic cross-sectional side views illustrating the junction and joining of floor panels, side wall panels, roof panels, and ridge beam to form a completed structure.
Figure 17B:
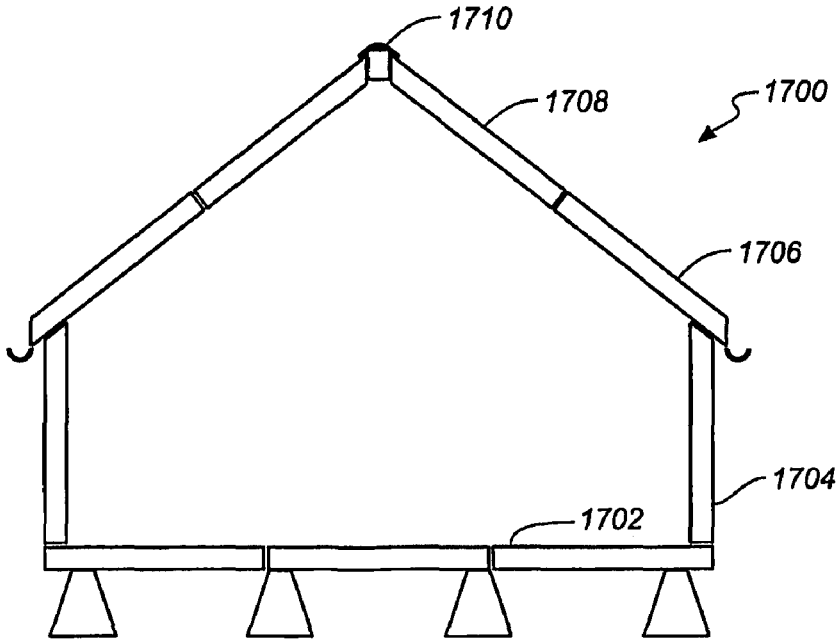

FIGS. 17A and 17B are schematic cross-sectional side elevation views illustrating the junction and joining of floor panels 1702, side wall panels 1704, lower roof panels 1706, upper roof panels 1708, and ridge beam 1710 to form a completed building structure 1700.

Figure 18A:
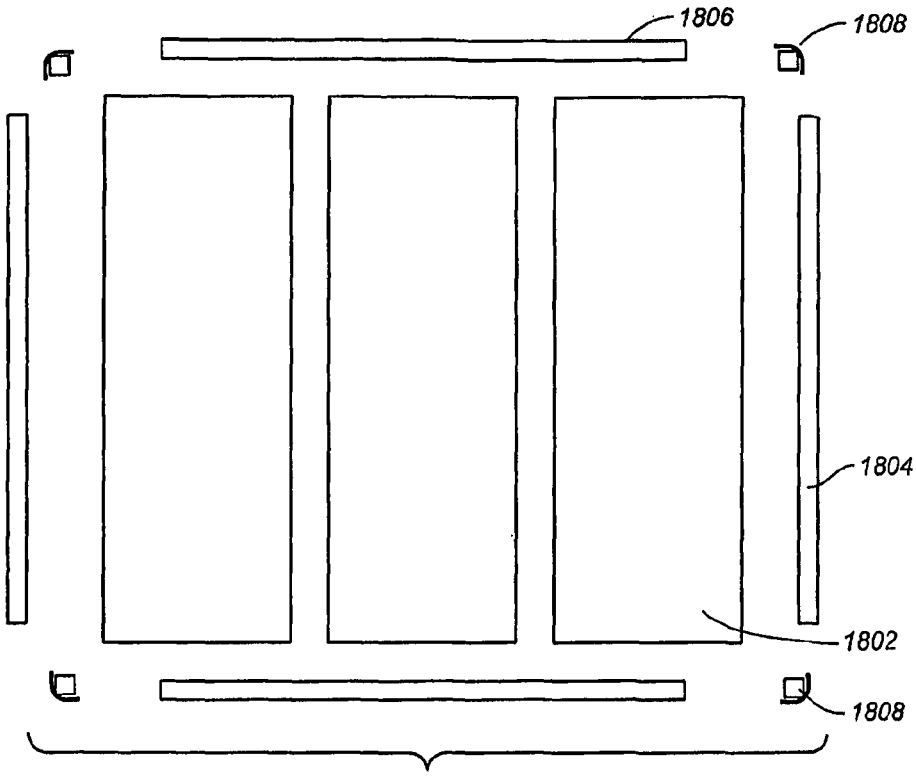
FIGS. 18A and 18B are schematic top plan views illustrating the junction and joining of floor panels, side wall panels, end wall panels, and corner posts to form a walled enclosure.
Figure 18B:
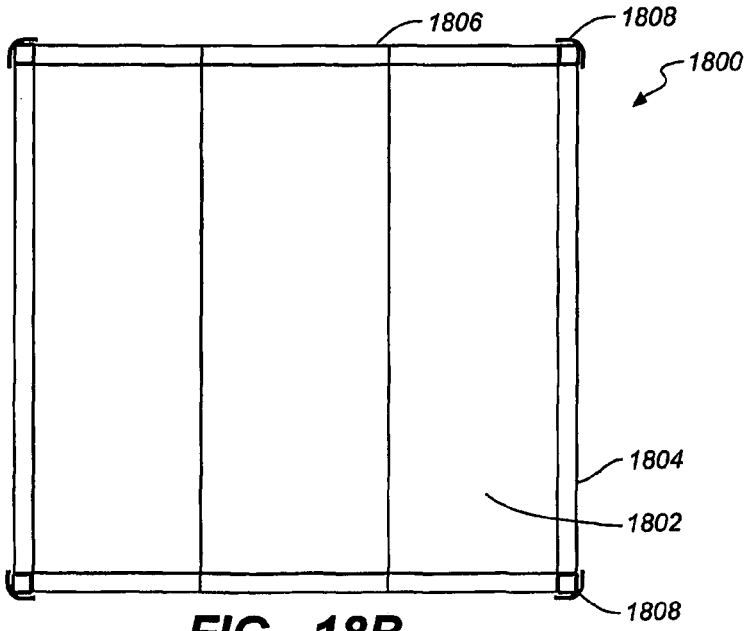

FIGS. 18A and 18B are schematic top plan views illustrating the junction and joining of floor panels 1802, side wall panels 1804, end wall panels 1806, and corner posts 1808 to form a walled enclosure 1800.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A housing element assembly, comprising:

a tongued unit having a clip disposed on a first side, an arcuate tongue disposed on a second side, a raised bead disposed on said first side of said tongued unit, and a sealing bead disposed on said second side of said tongued unit, and first and second recessed sections; and a grooved unit having a clip receptacle disposed on a first side for receiving said clip, an arcuate groove disposed on a second side for receiving said tongue, a bead mating groove on said first side of said grooved unit for receiving said raised bead, a sealing groove disposed on said second side for receiving said sealing bead;

wherein said tongued unit further includes two material layers and a stiffening element disposed there between, and said grooved unit includes first and second recessed sections, such that each of said material layers of said tongued unit fits flush in one of said first and second recessed sections of said grooved unit;

whereby said arcuate tongue of said tongued unit is inserted into said arcuate groove and is radially translated in relation to said grooved unit and used as a lever to press home said clip into said clip receptacle, such that said tongued unit mates with said grooved unit to form a positive fit.

* * * * *